US010141107B2

(12) United States Patent
Lee et al.

(10) Patent No.: US 10,141,107 B2
(45) Date of Patent: Nov. 27, 2018

(54) MINIATURE PLANAR TRANSFORMER

(71) Applicant: Analog Devices, Inc., Norwood, MA (US)

(72) Inventors: Check F. Lee, Bedford, MA (US); James Doscher, Westford, MA (US)

(73) Assignee: Analog Devices, Inc., Norwood, MA (US)

( * ) Notice: Subject to any disclaimer, the term of this patent is extended or adjusted under 35 U.S.C. 154(b) by 272 days.

(21) Appl. No.: 14/205,873

(22) Filed: Mar. 12, 2014

(65) Prior Publication Data

US 2015/0101854 A1 Apr. 16, 2015

Related U.S. Application Data

(60) Provisional application No. 61/889,206, filed on Oct. 10, 2013.

(51) Int. Cl.

| | |
|---|---|
| ***H01F 5/00*** | (2006.01) |
| ***H01F 27/02*** | (2006.01) |
| ***H01F 27/28*** | (2006.01) |
| ***H01F 41/04*** | (2006.01) |

(52) U.S. Cl.

CPC ..... *H01F 41/046* (2013.01); *H01F 27/2804* (2013.01); *H01F 2027/2809* (2013.01); *H01F 2027/2814* (2013.01); *Y10T 29/49073* (2015.01)

(58) Field of Classification Search

CPC ..... H01F 5/00; H01F 27/28
USPC ..... 336/83, 200, 232
See application file for complete search history.

(56) References Cited

U.S. PATENT DOCUMENTS

| | | | | |
|---|---|---|---|---|
| 3,132,316 | A | 5/1964 | Elmen et al. | |
| 4,012,703 | A * | 3/1977 | Chamberlayne | H01F 19/08 333/24 R |
| 4,975,671 | A | 12/1990 | Dirks | |
| 5,257,000 | A * | 10/1993 | Billings | H01F 17/0033 7/33 |
| 5,392,020 | A | 2/1995 | Chang | |
| 5,469,124 | A * | 11/1995 | O'Donnell | H01F 27/06 336/210 |
| 5,760,669 | A * | 6/1998 | Dangler | H01F 17/043 336/192 |
| 6,040,753 | A | 3/2000 | Ramakrishnan et al. | |

(Continued)

FOREIGN PATENT DOCUMENTS

| | | | |
|---|---|---|---|
| CN | 1324081 | A | 11/2001 |
| CN | 101018446 | A | 8/2007 |

(Continued)

OTHER PUBLICATIONS

Chinese Office Action dated Aug. 1, 2016 in connection with Chinese Application No. 201510245393.7 and English machine translation thereof.

*Primary Examiner* — Tsz Chan
(74) *Attorney, Agent, or Firm* — Wolf, Greenfield & Sacks, P.C.

(57) ABSTRACT

An inductive device may include a pair of half-shell magnetically-conductive housings joined together and defining an enclosed cavity between them. The inductive device may also include primary and secondary windings provided spatially within the cavity providing magnetic coupling between them. The windings may be electrically insulated from each other and terminals of the primary and secondary windings may traverse to an exterior of the inductive device.

23 Claims, 11 Drawing Sheets

(56) References Cited

U.S. PATENT DOCUMENTS

| | | | | |
|---|---|---|---|---|
| 6,069,548 | A * | 5/2000 | Baarman | H01F 27/2804 336/192 |
| 6,073,339 | A * | 6/2000 | Levin | H01F 17/0013 29/602.1 |
| 6,114,939 | A | 9/2000 | Wittenbreder | |
| 6,144,281 | A | 11/2000 | Lorris | |
| 6,188,305 | B1 | 2/2001 | Chang et al. | |
| 6,674,355 | B2 | 1/2004 | Harding | |
| 6,796,017 | B2 | 9/2004 | Harding | |
| 6,820,321 | B2 | 11/2004 | Harding | |
| 6,927,663 | B2 | 8/2005 | Iverson et al. | |
| 7,009,486 | B1 | 3/2006 | Goeke et al. | |
| 7,120,492 | B2 | 10/2006 | Iverson et al. | |
| 7,436,282 | B2 | 10/2008 | Whittaker et al. | |
| 7,477,124 | B2 | 1/2009 | Harding | |
| 2004/0032313 | A1 * | 2/2004 | Ferencz | H01F 27/266 336/200 |
| 2005/0231316 | A1 * | 10/2005 | Sato | H01F 27/255 336/212 |
| 2007/0296533 | A1 * | 12/2007 | Springett | H01F 27/22 336/200 |
| 2009/0126983 | A1 | 5/2009 | Harvey et al. | |
| 2009/0128273 | A1 | 5/2009 | Huss et al. | |
| 2011/0285492 | A1 | 11/2011 | Wang et al. | |
| 2012/0194314 | A1 | 8/2012 | Mo | |
| 2012/0320532 | A1 | 12/2012 | Wang | |
| 2013/0278730 | A1 | 10/2013 | Hasegawa et al. | |
| 2015/0332836 | A1 | 11/2015 | Lee | |

FOREIGN PATENT DOCUMENTS

| | | | | |
|---|---|---|---|---|
| CN | 201754363 | U | 3/2011 | |
| CN | 201927466 | U | 8/2011 | |
| CN | 102918609 | A | 2/2013 | |
| CN | 202841710 | U | 3/2013 | |
| DE | 2541871 | A1 | 3/1977 | |
| EP | 0 033 441 | A1 | 8/1981 | |
| EP | 0318955 | A1 * | 6/1989 | H01F 17/043 |
| JP | 54110424 | A * | 8/1979 | |
| JP | S61-051715 | U | 4/1986 | |
| JP | 02010705 | A | 1/1990 | |
| JP | 03044906 | A * | 2/1991 | |
| JP | H04-337610 | A | 11/1992 | |
| JP | 05055048 | A * | 3/1993 | |
| JP | H06-061055 | A | 3/1994 | |
| JP | H07-027177 | U | 5/1995 | |
| JP | H07-312313 | A | 11/1995 | |
| JP | 08031640 | A * | 2/1996 | |
| JP | 2009-212265 | A | 9/2009 | |
| TW | 200839801 | A | 10/2008 | |

* cited by examiner

TOP VIEW

SECTIONAL VIEW

200

300

700

700

700

MINIATURE PLANAR TRANSFORMER

PRIORITY CLAIM

The present application claims priority to U.S. Provisional Application No. 61/889,206, filed on Oct. 10, 2013, the entirety of which is incorporated by reference herein.

BACKGROUND

The subject matter of this application is directed to miniature electrical inductors and transformers and methods to manufacture these devices.

Transformers are used to transfer energy by inductive coupling between two sets of windings of the transformer. For example, a transformer may allow alternating voltages and/or currents of magnetically coupled windings to be stepped up or down. The ratio of the windings in a primary winding to those in a secondary winding determines the stepping ratio in ideal transformers.

Depending on the application, transformers are manufactured in varying sizes. Small transformers have been manufactured from discrete components. However, these transformers still take up significant amounts of space on the surface of a circuit board and are not always usable in high voltage applications. In addition, the manufacturing cost for transformers using discrete components can be significant.

Transformers have also been manufactured on dies of integrated circuits. However, manufacturing processes of such transformers includes depositing multiple layers of each material to form the transformer. Such manufacturing processes can be costly and take up significant amount of time. In addition, these transformers are not always usable in high voltage applications.

Accordingly, there is a need in the art for transformers that consume small amounts of space on the circuit board, are not expensive to manufacture, and can be included in high voltage applications.

BRIEF DESCRIPTION OF THE DRAWINGS

So that features of the present invention can be understood, a number of drawings are described below. It is to be noted, however, that the appended drawings illustrate only particular embodiments of the disclosure and are therefore not to be considered limiting of its scope, for the invention may encompass other equally effective embodiments.

DETAILED DESCRIPTION

Embodiments of the present invention provide miniature inductive devices and methods to manufacture them. The miniature inductive devices may be included high voltage applications and may be manufactured using standard printed circuit board (PCB) techniques.

According to one embodiment, an inductive device may include a ferrite core disposed inside a cavity in a printed circuit board (PCB) layer. A first conducting layer may be included on a first surface of the PCB layer, the first conducting layer including a plurality of horizontal electrode strips. A second conducting layer may be provided on a second surface of the PCB layer opposite to the first surface, the second conducting layer including a plurality of horizontal electrode strips. A plurality of metal plated through holes may extend from the electrode strips in the first conducting layer to the electrode strips in the second conducting layer, the through holes including a first set of through holes that are adjacent to a first side of the ferrite core and a second set of through holes that are adjacent to a second side of the ferrite core opposite to the first side.

According to another embodiment, an inductive device may include a ferrite housing disposed at least partially inside a cavity of a printed circuit board (PCB) layer. The ferrite housing may include a cavity for one or more windings. One or more spiral windings may be disclosed inside the winding cavity. An insulator may be included inside the winding cavity and between the spiral winding and a surface of the ferrite housing.

Figure 1A:
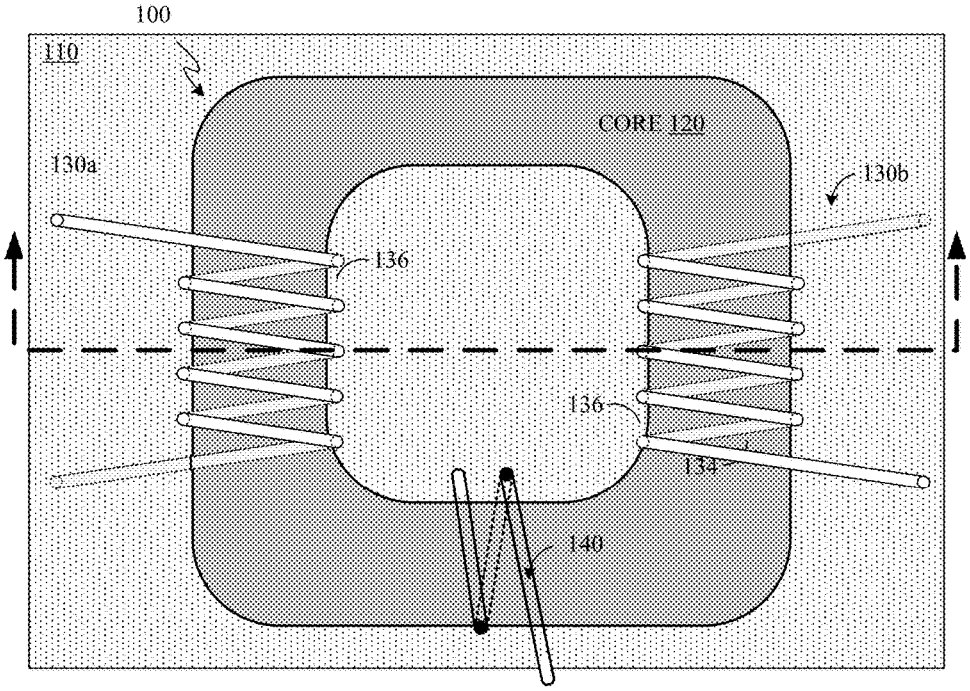
FIGS. 1A-1C illustrate a transformer according to an embodiment of the present invention.

FIG. 1A illustrates a top view and FIG. 2B illustrates a sectional view of a transformer 100 according to an embodiment of the present invention. The transformer 100, may include a dielectric panel 110, a ferrite core 120, and first and second windings 130*a*, 130*b*. The first and second windings 130*a*, 130*b* may include a first conducting layer 132, a second conducting layer 134, and conducting through holes (vias) 136 in panel 110.

The first conducting layer 132, the second conducting layer 134, and the conducting through holes 136 may be arranged around portions of the ferrite core 120 (i.e., magnetic member) to form the first and second windings 130*a*, 130*b*. The first conducting layer 132, which may correspond to a bottom metal PCB layer, may be positioned below the ferrite core 120. The second conducting layer 134, which may correspond to a top metal PCB layer, may be positioned above the ferrite core 120. The second conducting layer 134 may be positioned on a side of the ferrite core 120 that is opposite to a side of the ferrite core 120 on which the first conducting layer 132 is provided.

The through holes 136 may connect conducting strips of the first conducting layer 132 to conducting strips of the second conducting layer 134. An insulator (e.g., having the same material as the dielectric panel 110) may be included between the ferrite core 120 and the first conducting layer 132, the second conducting layer 134, and the through holes 136. The conducting through holes 136 may include, for example, blind via, buried via, or a through hole via.

The dielectric panel 110 may be a printed circuit board (PCB) including a plurality of layers. The PCB may include one or more conducting layers (e.g., on a top surface, on a bottom surface or within the dielectric panel 110) and a non-conducting substrate between the conducting layers. The PCB may include other electronic components (not shown in FIG. 1A) and conducting tracks and pads connecting these components. The PCB may include components (e.g., capacitors, resistors or active devices) embedded in the substrate or on a surface of the substrate. The first and second windings 130*a*, 130*b* may be coupled to one or more of the components on or within the PCB.

The ferrite core 120 may have a circular washer shape, a rectangular washer shape, or a square washer shape, but is not so limited. The washer shape of the ferrite core 120 may provide a planar ferrite core with an opening (e.g., corresponding to an outer shape of the ferrite core) in the ferrite core 120. The edges of the ferrite core 120 may be rounded or may be sharp. The ferrite core 120 may be provided within one or more layers of the PCB.

The first conducting layer 132 and the second conducting layer 134 may include copper strips. As shown in FIG. 1A, the strips of the first conducting layer 132 may be parallel to each other, and the strips of the second conducting layer 134 may be parallel to each other. In another embodiment (not shown in FIG. 1A), the strips of the first conducting layer 132 may be parallel to the strips of the second conducting layer 134. The spacing between the ferrite core 120 and the first conducting layers 132 may be as small as a manufacture process allow. In one embodiment, the spacing between the ferrite core 120 and the first conducting layer 132 may approximately equal a thickness of the conducting strips in the first conducting layer 132. Similarly, the spacing between the ferrite core 120 and the second conducting layer 134 may be as small as a manufacture allow. In one embodiment, the spacing between the ferrite core 120 and the second conducting layer 134 may approximately equal a thickness of the conducting strips in the second conducting layer 134. The thickness of the first conducting layer 132 may be equal to the thickness of the second conducting layer 134. In one embodiment, the spacing between the adjacent strips of the conducting layers 132, 134 may be equal to or be larger than the thickness of the strips of the conducting layers 132, 134, respectively.

The spacing between the through holes 136 and the ferrite core 120 may be as small as a manufacture process allow. In one embodiment, the spacing may approximately equal the thickness of the first conducting layer 132 or the second conducting layer 134. In another embodiment, the spacing between the through holes 136 and the ferrite core 120 may equal a distance between adjacent strips of the first conducting layer 132 or the second conducting layer 134. In another embodiment, the spacing between the through holes 136 and the ferrite core 120 may equal the width of the through holes 136.

The total height of the transformer 100 including the ferrite core 120 and the first and second conducting layers 132,134 may be approximately 1 mm.

As shown in FIG. 1A, the transformer 100 may include an additional winding 140. The additional winding 140 may be a sensing winding coupled to a circuit measuring parameters of the magnetic field generated in the transformer 100. The additional winding 140 may include one or more winding around a portion of the ferrite core 120.

Figure 1B:
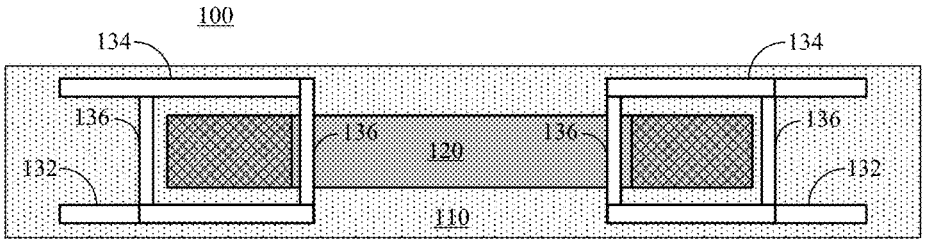
Figure 1C:
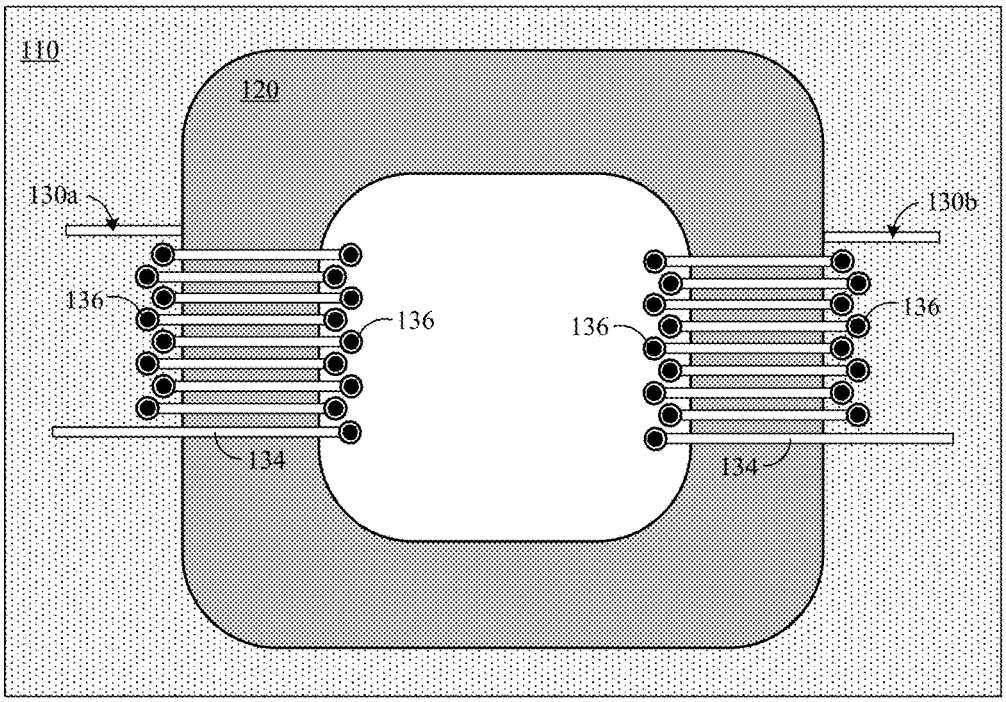

FIG. 1C illustrate an alternative arrangement of the windings 130*a* and 130*b* around the ferrite core 120. As shown in FIG. 1B, the spacing between the strips of the first and the second conducting layers 132, 134 in FIG. 1A may be reduced by staggering the strips. Staggering the strips of the first and the second conducting layers 132, 134 may allow for the spacing between the adjacent strips to be approximately equal to the width of the strips (e.g., 20 μm), which may be less than the width of the via pad 136.

While a transformer is illustrated in the figures, the structures and manufacturing processes of the transformer are not limited to the shown transformers and may be included in other inductive devices (e.g., inductors or transformers including multiple windings on a primary and/or a secondary side). The transformer may be a four terminal transformer. The inductor may be a two terminal inductor. The transformer may be included in low and/or high voltage applications. In high voltage application the voltage between the windings of the transformer may exceed 500V. The transformer may be part of a PCB including other electronic components which may be coupled to the transformer.

Figure 2:
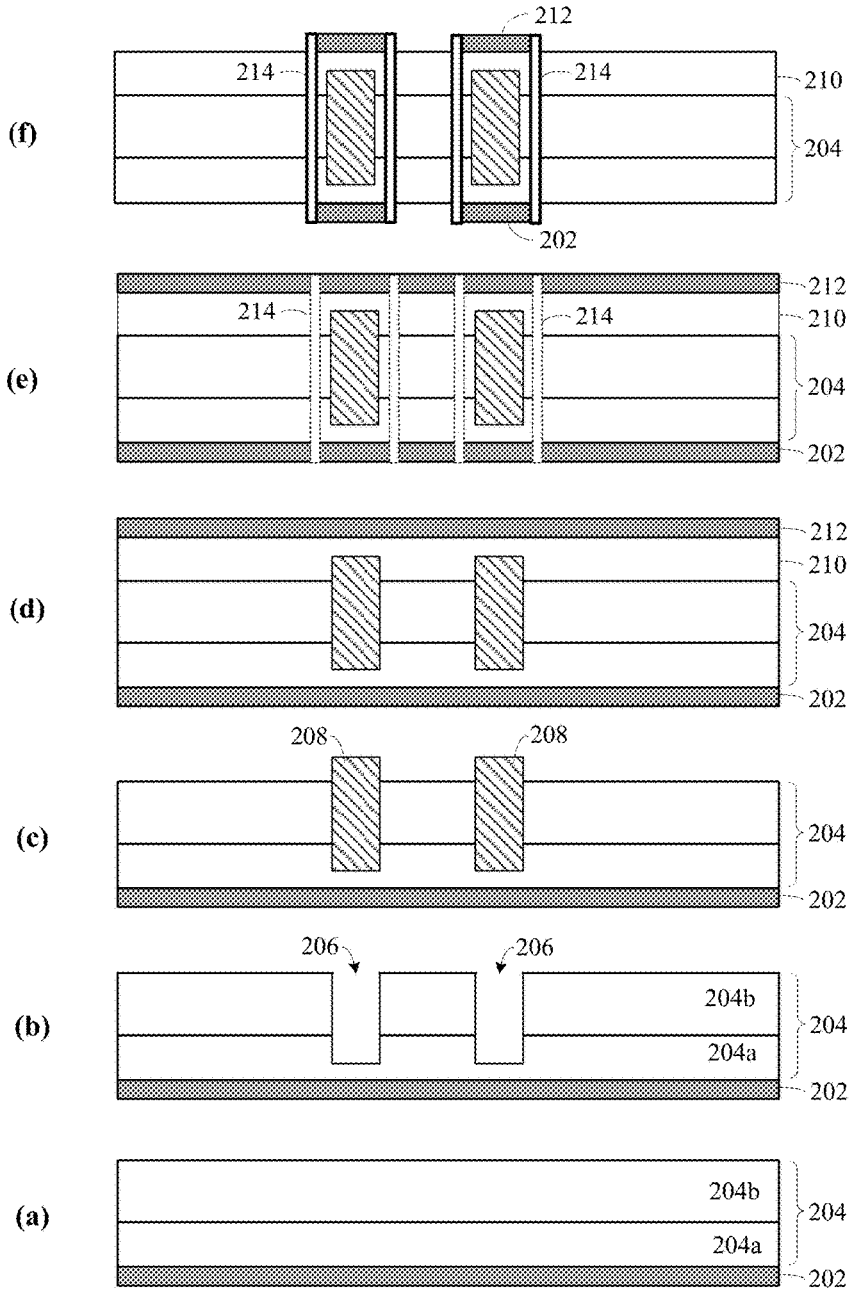
FIG. 2 illustrates the process for manufacturing an inductive device embedded in a PCB according to an embodiment of the present invention.

FIG. 2 illustrates the process for manufacturing transformer 200 embedded in a PCB according to an embodiment of the present invention. The process may include (a) providing a first conducting layer 202 with one or more dielectric layers 204 (e.g., insulating layers), (b) forming a cavity 206 in the dielectric layers 204, (c) inserting a ferrite core 208 inside the cavity 206, (d) providing a top dielectric layer 210 and a second conducting layer 212, (e) forming a plurality of through holes 214, and (f) plating the through holes 214 and etching the first and second conducting layers 202, 212.

The first conducting layer 202 may be provided on a first surface (e.g., bottom surface) of a first dielectric layer 204*a*. The first conducting layer 202 may include a copper layer. The dielectric layers 204 may include an electrical insulator, an FR-4 epoxy laminate sheet or a prepreg. The first conducting layer 202 may be formed over the complete surface of the first dielectric layer 204*a*. One or more additional dielectric layers 204*b* may be provided above the first dielectric layer 204*a*. The additional dielectric layers 204*b* may be laminated onto a second surface of the first dielectric layer 204*a* that is opposite to the first surface including the first conducting layer 202. The additional dielectric layers 204*b* may include conducting layers (not shown in FIG. 2) that are part of other circuits or components. The number of dielectric layers 204 that are provided above the first conducting layer 202 may depend on the size of the ferrite core 208 and the thickness of the dielectric layers.

Forming the cavity 206 in the dielectric layer 204 may include forming the cavity 206 that corresponds to a shape of the ferrite core 208. Forming the cavity 206 may include drilling and/or routing one or more dielectric layers 204 to provide the cavity 206. The depth of the cavity 206 may be less than the thickness of the ferrite core 208, may equal the thickness of the ferrite core 208, or may exceed the thickness of the ferrite core 208. In one embodiment, a plurality of cavities may be formed for different ferrite cores.

The ferrite core 208 may be inserted inside the cavity 206. The ferrite core 208 may be placed against a bottom surface of the cavity 206. As shown in FIG. 2, a portion of the ferrite core 208 may be outside of the cavity 206. In other embodiments, if the depth of the cavity 206 equals or exceeds the thickness of the ferrite core 208, the ferrite core 208 may be inserted completely within the cavity 206. The ferrite core 208 may have a circular washer shape, a rectangular washer shape, or a square washer shape, but is not so limited. The washer shape of the ferrite core 208 may provide a planar ferrite core with an opening (e.g., corresponding to an outer shape of the ferrite core) in the ferrite core 208. The edges of the ferrite core 208 may be rounded or may be sharp, for example, corresponding to the shape of the cavity 206. A gel may be provided inside the cavity 206 to align the ferrite core 208 inside the cavity 206.

The top dielectric layer 210 may be provided above the ferrite core 208. The top dielectric layer 210 may be pressed onto a top surface of the dielectric layers 204 including the cavity 206. In one embodiment, a second cavity may be formed in the top dielectric layer 210 to enclose a portion of the ferrite core 208 outside of the cavity 206. In one embodiment (not shown in FIG. 2), the top dielectric layer 210 may be pressed only against a top surface of the ferrite core 208.

The second conducting layer 212 may be provided above the dielectric layer 210. The second conducting layer 212 may be pressed onto a first surface of the top dielectric layer 210 that is opposite to a second surface that is adjacent to the ferrite core 208. The second conducting layer 212 may be a copper foil applied with an epoxy or other adhesive to the top dielectric layer 210. In another embodiment, the second conducting layer 212 may be part of the top dielectric layer 210 that is provided above ferrite core 208.

The plurality of through holes 214 may be formed through the dielectric layers 204, 210 and the first and second conducting layers 202, 212. The through holes 214 may be formed using, for example, a drill or a laser. As shown in FIGS. 1A, 1B and 2, the through holes 214 may be formed next to the ferrite core 208. The through holes 214 may be formed next to a portion of an outside perimeter of the ferrite core 208 and next to a portion of an inside perimeter of the ferrite core 208. The though holes 214 may be through hole vias going from the top layer to the bottom layer of the PCB.

In an embodiment including additional PCB layers above or below the first or second conducting layers 202 and 212, the though holes 214 may be blind vias or buried vias. The through holes 214 may be drilled such that they are perpendicular to the surface of the PCB. The plurality of through holes 214 may be plated with a conductor to provide electrical connections between the first conducting layer 202 and the second conducting layer 212.

The first and second conducting layers 202, 212 may be etched to provide a plurality of conducting strips in the first and second conducting layers 202, 212. The etching of the first and second conducting layers 202, 212 may be performed after the through holes 214 are dilled and plated. As shown in FIG. 1A, the strips of the first conducting layer 202 may be parallel to each other, and the strips of the second conducting layer 212 may be parallel to each other.

In one embodiment, the strips of the first and second conducting layers 202, 212 may be approximately aligned and positioned above each other. With this embodiment, etching of the first and second conducting layers 202, 212 may be done using the same mask.

Figure 3:
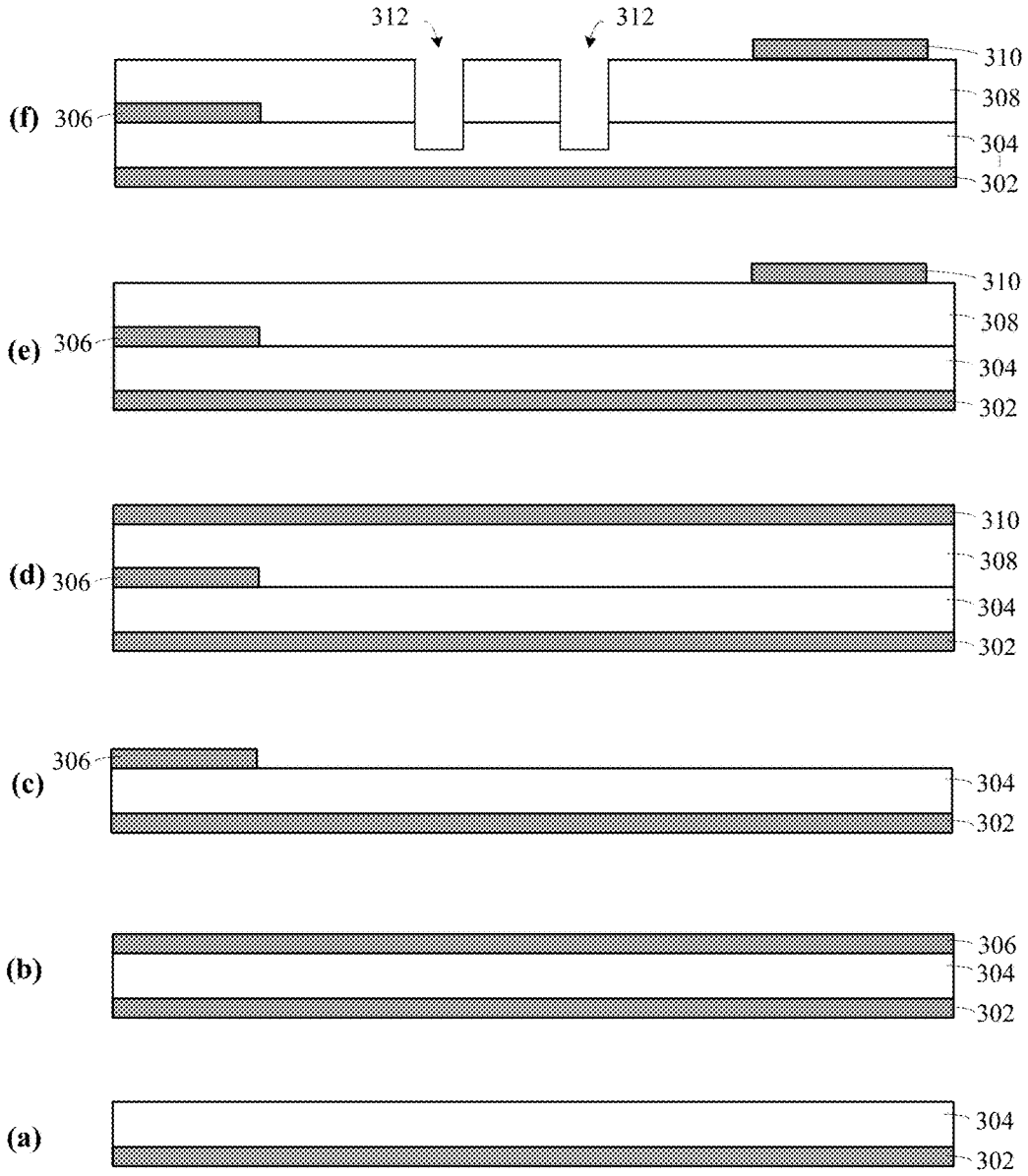
FIG. 3 illustrates the process for manufacturing a support layer for an inductive device according to an embodiment of the present invention.

FIG. 3 illustrates the process for manufacturing a support layer 300 for a transformer according to an embodiment of the present invention. The support layer 300 may correspond to the support layer 400 shown in FIG. 4. The process may include (a) providing a first outer conducting layer 302 with a first dielectric layer 304, (b) providing a first inner conducting layer 306, (c) etching the first inner conducting layer 306, (d) providing a second dielectric layer 308 and a second inner conducting layer 310, (e) etching the second inner conducting layer 310, and (f) forming a cavity 312 in the dielectric layers 308 and/or 304.

The first outer conducting layer 302 may be provided on a first surface (e.g., bottom surface) of a first dielectric layer 304. The first outer conducting layer 302 may include a copper layer. The first outer conducting layer 302 may form the windings of the transformer. The first dielectric layer 304 may include an FR-4 epoxy laminate sheet or prepreg. The first outer conducting layer 302 may be formed over the complete surface of the first dielectric layer 304.

The first inner conducting layer 306 may be provided above the first dielectric layer 304. The first inner conducting layer 306 may be pressed on a second surface (e.g., top surface) of the first dielectric layer 304, which is opposite to the first surface including the first outer conducting layer 302. The first inner conducting layer 306 may be formed over the complete second surface of the first dielectric layer 304. The first inner conducting layer 306 may be etched to provide circuits and/or components from the first inner conducting layer 306. The circuits and/or components including the first inner conducting layer 306 may be coupled to the windings of the transformer.

The second dielectric layer 308 and the second inner conducting layer 310 may be provided over the first inner conducting layer 306. The second dielectric layer 308 may be provided over the etched first inner conducting layer 306 and the exposed second surface of the first dielectric layer 304. The second inner conducting layer 310 may be provided over a complete surface of the second dielectric layer 308 that is opposite to the surface adjacent to the first inner conducting layer 306. The second inner conducting layer 310 may be etched to provide circuits and/or components from the second inner conducting layer 310. The circuits and/or components including the second inner conducting layer 310 may be coupled to the windings of the transformer.

Forming the cavity 312 in the dielectric layers 308 and/or 304 may include forming the cavity 312 that corresponds to the shape of the ferrite core (e.g., ferrite core 120 shown in FIG. 1A). Depending on the desired depth of the cavity 312, the cavity 312 may be formed in only the second dielectric layer 308 or the cavity may be formed in the first and second dielectric layer 304 and 308. Forming the cavity 312 may include drilling and routing the dielectric layers 308 and/or 304 to provide the cavity 312. The depth of the cavity 312 may be less than the thickness of the ferrite core, may equal the thickness of the ferrite core, or may exceed the thickness of the ferrite core. In one embodiment, a plurality of cavities may be formed for different ferrite cores.

One or more additional dielectric layers (not shown) and/or conducting layers may be formed above the second dielectric layer 308 and the second inner conducting layer 310. The cavity 312 may extend through the one or more additional dielectric layers.

Through holes (not shown in FIG. 3) may be formed to couple two or more of the first outer conducting layer 302, the first inner conducting layer 306 and the second inner conducting layer 310. The through holes may be formed before the second inner conducting layer 310 is etched.

Figure 4:
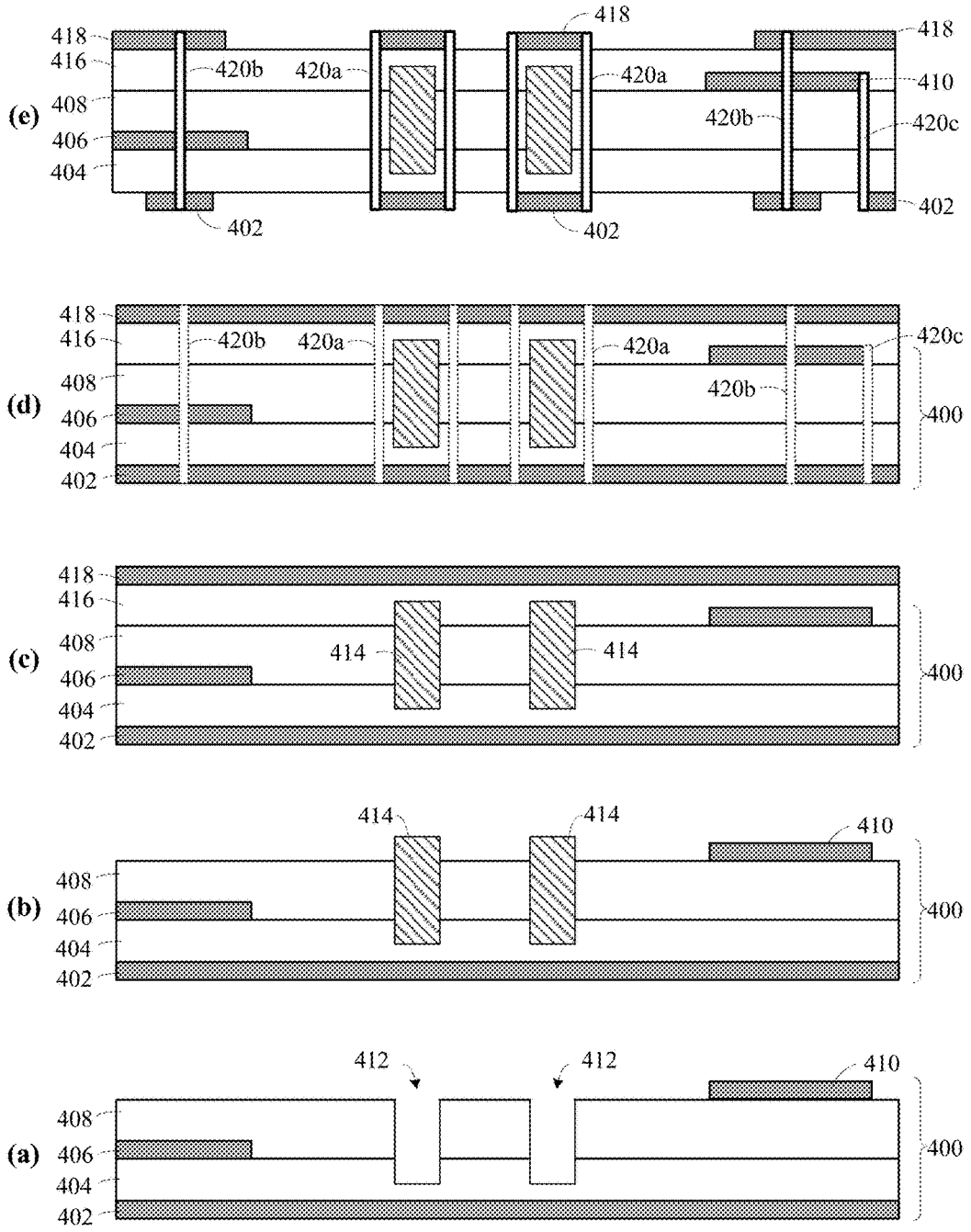
FIG. 4 illustrates the process for manufacturing an inductive device embedded in a PCB with additional conducting layers according to an embodiment of the present invention.

FIG. 4 illustrates the process for manufacturing a transformer embedded in a PCB with additional conducting layers according to an embodiment of the present invention. The process may include (a) providing a support layer 400 including a cavity 412, (b) inserting a ferrite core 414 inside the cavity 412, (c) providing a top dielectric layer 416 and a second conducting layer 418 above the ferrite core 414, (d) forming a plurality of through holes 420, and (e) plating the through holes 420 and etching the first and second conducting layers 402 and 418.

The support layer 400 may include a plurality of conducting layers 402, 406, 410, and a plurality of dielectric layers 404 and 408. The support layer 400 may be manufactured, for example, according to methods discussed with reference to FIG. 3. The plurality of conducting layers may include a first conducting layer 402 provided on a first side of the support layer 400 and one or more inner conducting layers 406 and 410. The inner conducting layers 406 and 410 may be provided between the plurality of dielectric layers 404 and 408 or on an outside surface of the dielectric layer 408. The inner conducting layers 406 and 410 may be parts of circuits or components that are coupled to the inductive device.

On or more of the conducting layers 402, 404, 410 may include a copper layer. The dielectric layers 404 and 408 may include an FR-4 epoxy laminate sheet or prepreg. The first conducting layer 402 may be formed over the complete surface of the first dielectric layer 404.

The cavity 412 may be provided as part of the support layer 400 or formed in the support layer 400 (e.g., by drilling or routing). The ferrite core 414 may be inserted inside the cavity 412. The ferrite core 414 may be placed against a bottom surface of the cavity 412. A portion of the ferrite core 414 may be outside of the cavity 412. In other embodiments, if the depth of the cavity 412 equals or exceeds the thickness of the ferrite core 414, the ferrite core 414 may be inserted completely within the cavity 412.

The ferrite core 414 may have a circular washer shape, a rectangular washer shape, or a square washer shape, but is not so limited. The washer shape of the ferrite core 414 may provide a planar ferrite core with an opening (e.g., corresponding to an outer shape of the ferrite core) in the ferrite core 414. A gel may be provided in the cavity 412 to align and/or stabilize the ferrite core 414. After the ferrite core 414 is positioned in the cavity 412 the gel may be hardened.

The top dielectric layer 416 may be provided above the ferrite core 414. The top dielectric layer 416 may be pressed onto a top surface of the support layer 400 (e.g., the top surface of the dielectric layers 408). In one embodiment, a second cavity may be formed in the top dielectric layer 416 to enclose a portion of the ferrite core 414 outside of the cavity 412. In one embodiment (not shown in FIG. 4), the top dielectric layer 416 may be pressed only against a top surface of the ferrite core 414.

The second conducting layer 418 may be provided above the dielectric layer 416. The second conducting layer 418 may be pressed onto a first surface of the top dielectric layer 416 that is opposite to a second surface that is adjacent to the ferrite core 414. The second conducting layer 418 may be a copper foil applied with an epoxy or other adhesive to the top dielectric layer 416. In another embodiment, the second conducting layer 418 may be part of the top dielectric layer 416 that is provided above ferrite core 414.

The plurality of through holes 420, including through holes 420*a*, 420*b* and 420*c*, may be formed through the dielectric layers 404, 408 and 416, and/or the conducting layers 402, 418, 406 and 410. The through holes 420 may be formed by, for example, a drill or a laser. As shown in FIGS. 1A, 1C and 4, the through holes 420*a*, which will form the winding of the inductive device, may be drilled next to the ferrite core 414. For example, the through holes 420*a* may be drilled next to a portion of an outside perimeter of the ferrite core 414 and next to a portion of an inside perimeter of the ferrite core 414. The through holes 420*b* and 420*c* may form connections between other components and circuits on the PCB. The other components and circuits on the PCB may be coupled to the inductive device embedded in a PCB.

The though holes 420*a* and 420*b* may be through hole vias going from the top layer to the bottom layer of the PCB. The through holes 420 may include blind through hole vias 420*c* and buried through hole vials (not shown). The through holes 420 may be drilled such that they are perpendicular to the surface of the PCB. The plurality of through holes 420*a* may be plated with a conductor to provide electrical connections between the first conducting layers 402 and the second conducting layer 418. The plurality of through holes 420*b* and 420*c* may be plated with a conductor to provide electrical connections between inner conducting layers 406 and the one or more of the outer conducting layers 402 and 418. The through holes 420*b* and 420*c* may be coupled to conducting layers that are coupled to the windings of the inductive device.

The first and second conducting layers 402 and 418 may be etched to provide a plurality of conducting strips in the first and second conducting layers 402 and 418. The conducting strips of the first and second conducting layers 402 and 418 may form the windings of the inductive device and/or part of other circuits and/or components. The etching of the first and second conducting layers 402 and 418 may be performed after the through holes 420 are formed and/or plated.

As shown in FIG. 1A, the strips of the first conducting layer 402 forming the windings may be parallel to each other, and the strips of the second conducting layer 418 forming the windings may be parallel to each other. In one embodiment, the strips of the first and second conducting layers 402 and 418 forming the windings may be approximately aligned and positioned above each other.

Figure 5:
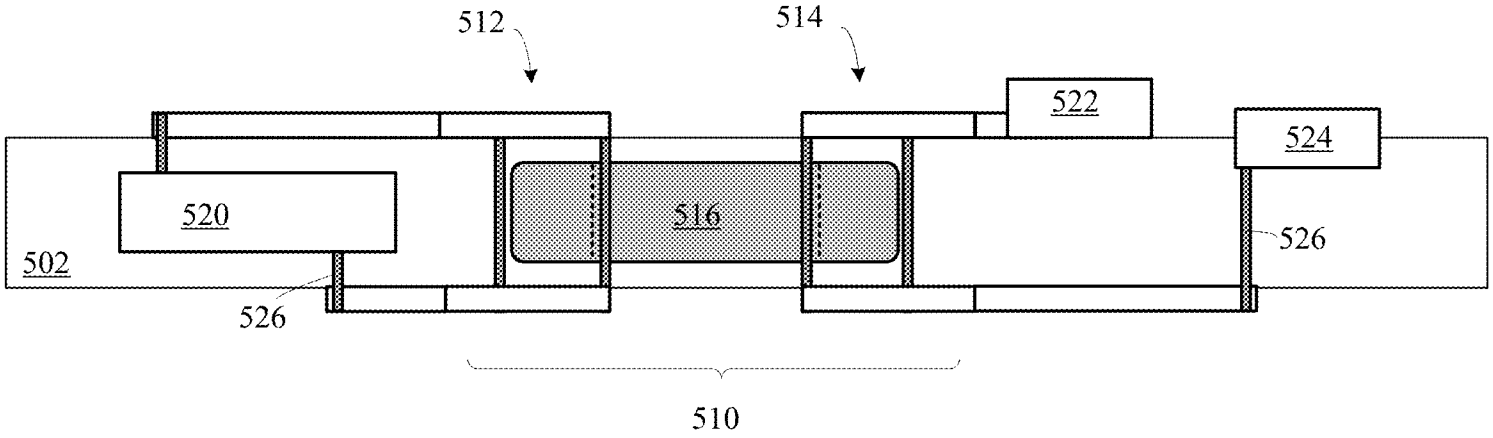
FIG. 5 illustrates an inductor with circuit components in the same substrate according to an embodiment of the present invention.

FIG. 5 illustrates an inductor 510 with circuit components in the same substrate 502 according to an embodiment of the present invention. The transformer 510 may include a first winding 512, second winding 514 and a ferrite core 516. The transformer 510 may be the transformer shown in FIG. 1 or 7. The transformer 510 may be manufactured according to one or more of the embodiment of the disclosure.

As shown in FIG. 5, the windings 512, 514 of the transformer 510 may be coupled to one or more other components 520, 522 and 524 which are part of the substrate 502 (e.g. PCB) including the transformer 510. The components 520, 522 and 524 may be included inside, partially inside, or on a surface of the substrate 502. The components 520, 522 and 524 may be coupled to the transformer 510 via additional through holes 526 and/or traces in the substrate 502. The components 520, 522 and 524 may be power supply components, integrated circuits or other circuit components interfacing with the first winding 512 (e.g., primary winding) and/or the second winding 514 (e.g., secondary winding). For example, the component 520 may be a driver integrated circuit driving the first winding 512 of the transformer 510 and the components 522 and 524 may be an integrated circuit or a discrete electronic rectifier coupled to the second winding 514 to rectify signals transferred from the first winding 512 to the second winding 514.

The components 520, 522 and 524 may be embedded in the substrate 502 or on a surface of the substrate 502 in the same process used to manufacture the transformer 510. In one embodiment, the one or more of the components 520, 522 and 524 may be inserted into cavities that are provided next to the cavity including the ferrite core 516 of the transformer 510. The conductor layers forming the windings 512, 514 of the transformer 510 may also couple the components 520, 522 and 524 to the windings 512, 514.

In another embodiment, the transformer 510 may be an inductor that is coupled to an integrated circuit or discrete circuit included in the substrate 502. The transformer 510 may be provided outside of the integrated circuit or discrete circuit in applications that cannot include the inductive device 510 as part of the integrated circuit die or where it is not economical.

Figure 6:
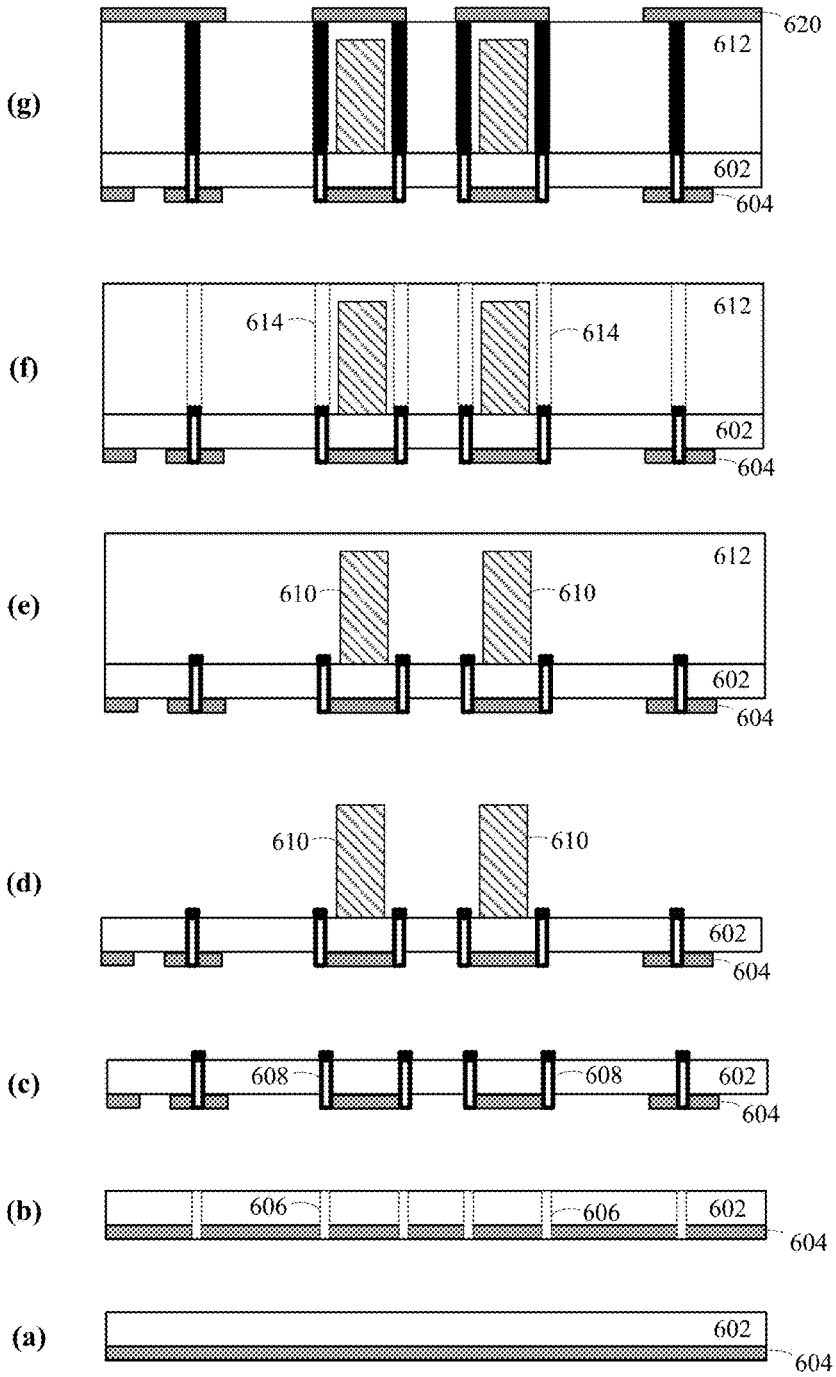
FIG. 6 illustrates the process for manufacturing embedded transformer in a PCB according to another embodiment of the present invention.

FIG. 6 illustrates the process for manufacturing embedded transformer in a PCB according to another embodiment of the present invention. The process may include (a) providing a base dielectric layer 602 including a first conducting layer 604 on a first surface of the dielectric layer 602, (b) providing through holes 606 in the base dielectric layer 602 and the first conducting layer 604, (c) forming buried vias in the base dielectric layer 602 and etching the first conducting layer 604, (d) placing a ferrite core 610 above the base dielectric layer 602, (e) providing a top dielectric layer 612 over the ferrite core 610, (f) forming through holes 614 in the top dielectric layer 612, and (g) plating the through holes 614 and providing a second conducting layer 620.

The first conducting layer 604 may be laminated on the first surface of the dielectric layer 602. The first conducting layer 604 may be a copper foil applied with an epoxy or other adhesive to the surface of the first surface of the dielectric layer 602.

The through holes 606 may be provided in the first conducting layer 604 and the dielectric layer 602. The through holes 606 may be drilled by, for example, a drill or a laser. The through holes 606 may include through holes which will form the winding of the transformer and through holes which will form other circuit or components that are part of the PCB. The through holes 606 that will be part of the windings may be drilled in the patterns shown in FIG. 1A or 1B. The through holes 606 may form buried vias 608 in the base dielectric layer 602.

The first conducting layer 604 may be etched to form strips that will be part of the windings and to form other circuit components (e.g., that will not be part of the windings). The blind vias 608 in the base dielectric layer 602 may be coupled to the etched first conducting layer 604.

The ferrite core 610 may be placed on a surface of the base dielectric layer 602 that is opposite to the surface including the first conducing layer 604. The ferrite core 610 may have a circular washer shape, a rectangular washer shape, or a square washer shape, but is not so limited. The washer shape of the ferrite core 610 may provide a planar ferrite core with an opening (e.g., corresponding to an outer shape of the ferrite core) in the ferrite core 610.

The top dielectric layer 612 may be provided to enclose the ferrite core 610. The top dielectric layer 612 may be a dielectric layer that includes a cavity corresponding to the shape of the ferrite core 610. In another embodiment, the top dielectric layer 612 may be a prepreg or jell that is deposited and hardened to form the top dielectric layer 612. In one embodiment, the prepreg or jell may be deposited in layers. As shown in FIG. 6, the top dielectric layer 612 may completely enclose the ferrite core 610 and form a layer above the ferrite core 610.

The through holes 614 may be formed in the top dielectric layer 612 to provide connections to the buried vias 608 in the base dielectric layer 602. Depending on the depth of the through holes 614, the top dielectric layer 612 may be drilled or etched to form the through holes 614. The through holes 614 may be filed or plated with a conductor (e.g., copper).

The second conducting layer 620 may be provided above the top dielectric layer 612 to provide conducting strips forming the windings and other circuit components. The second conducting layer 620 may be provided by laminating a conductor layer on the surface of the top dielectric layer 612 and etching the conductor layer. In another embodiment, a dielectric layer including the second conducting layer 620 may be provided on the top dielectric layer 612. The second conducting layer 620 may include strips that will form parts of the windings.

In another embodiment, the second conducting layer 620 may be preformed and deposited on the surface of the top dielectric layer 612. Additional conducting layers that are not part of the windings may be provided within or between the top dielectric layer 620 and the base dielectric layer 602.

Figure 7A:
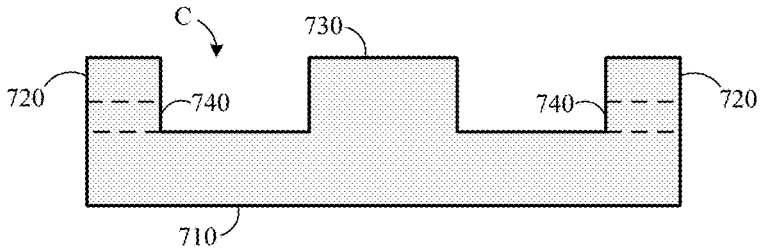
FIGS. 7A-7C illustrate a core half-shell according to an embodiment of the present invention.
Figure 7B:
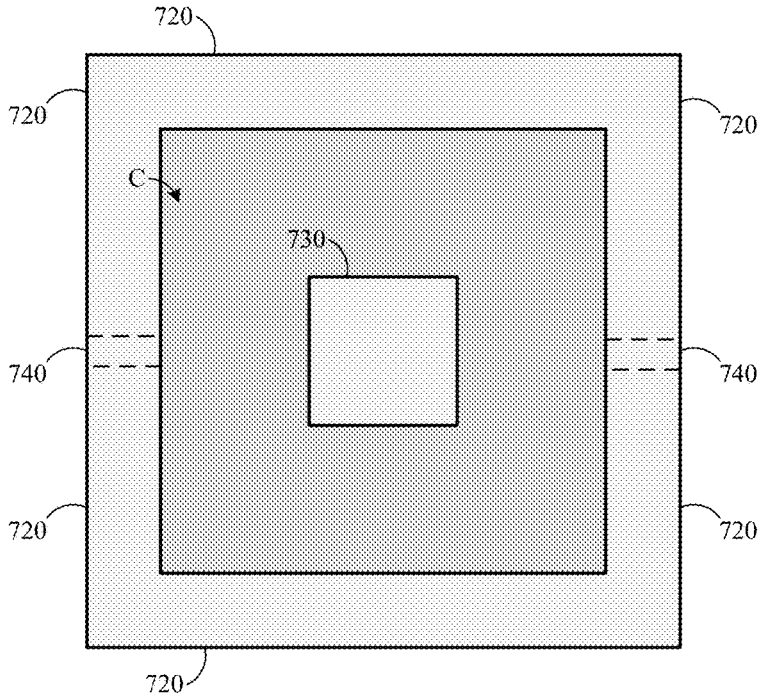
Figure 7C:
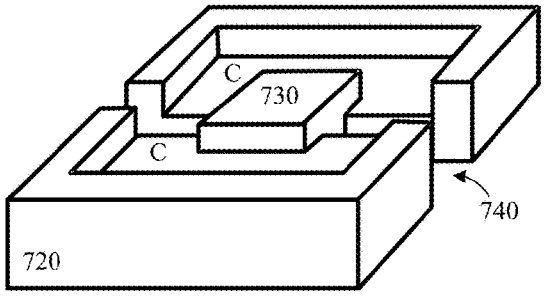

FIGS. 7A-7C illustrate a core half-shell 700 according to an embodiment of the present invention. FIG. 7A illustrates a sectional view of the half-shell 700, FIG. 7B illustrates a plan view of the same half-shelf, and FIG. 7C illustrates a perspective view of the half-shell 700. The half-shell 700 may be a unitary structure made of magnetically-conductive material such as ferrite. As its name implies, the half-shell is designed to cooperate in a paired fashion with a second half-shell (not shown) to build a complete magnetic core.

The half-shell 700 may include a base 710 and a plurality of sidewalls 720 that define a cavity C to accommodate windings of an inductive device (not shown). The base 710 and sidewalls 720 define a profile of the half-shell 700. In an embodiment, the profile may be designed to permit the half-shell 700 to be registered with a counterpart half-shell when the two are mated together.

In an embodiment, the half-shell 700 also may include a projection 730 that extends from the base 710 into the cavity. The projection 730 may extend to a height that matches a top profile of the sidewalls 720. The projection 730, along with the sidewalls 720, may define a shape of the cavity C as some sort of annulus. Although a square-shaped annulus is illustrated in FIG. 7, the principles of the present invention accommodate other geometric arrangements such as circles, rectangles, hexagons, octagons, etc.

Optionally, the half-shell 700 also may have one or more channels 740 provided in either the sidewalls 720 or the base 710 to accommodate conductors that make up the winding(s) of the inductive device (not shown). In an embodiment, the channels 740 may be pre-formed into the half-shell 700. In other embodiments, channels 740 may be formed in the half-shell when the inductive device is manufactured, for example, by drilling.

Figure 8A:
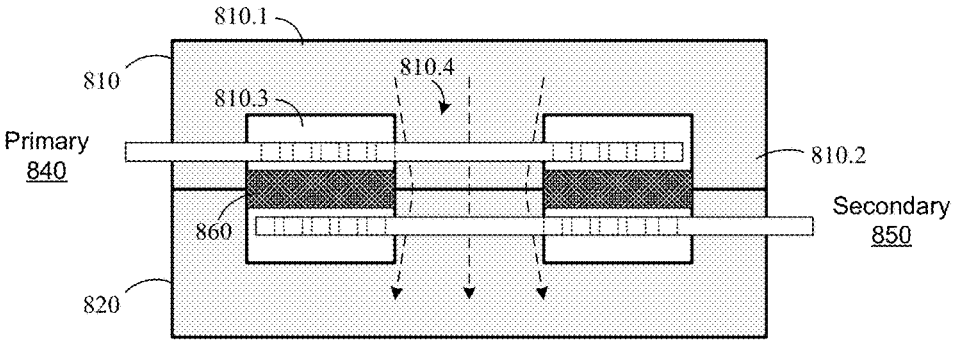
FIGS. 8A and 8B illustrate a magnetic core including one or more windings according to an embodiment of the present invention.
Figure 8B:
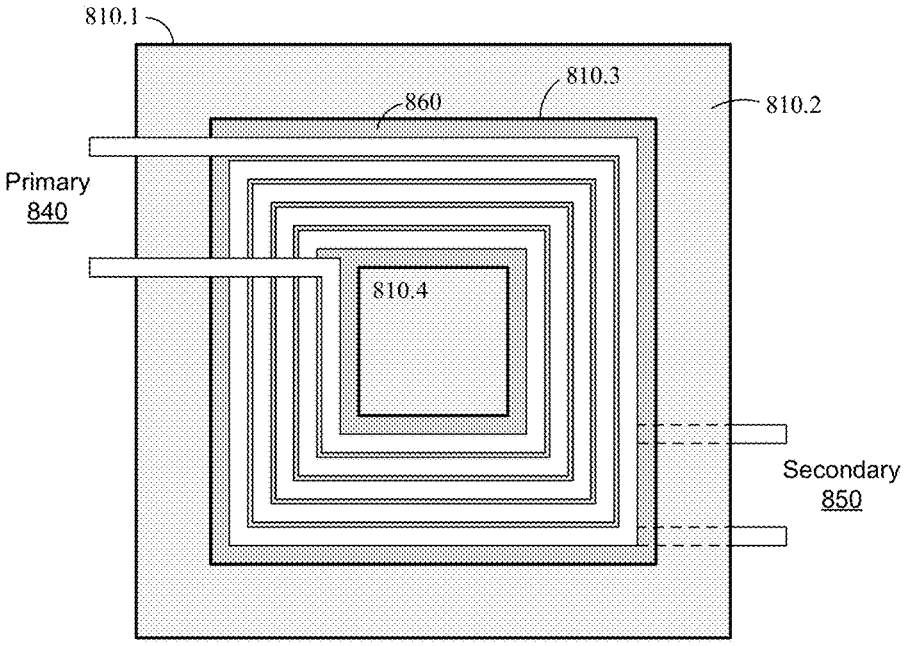

FIGS. 8A and 8B illustrate a magnetic core 800 including one or more windings according to an embodiment of the present invention. FIG. 8A illustrates a sectional view of the magnetic core 800 and FIG. 8B illustrates a plan view of the same core. The core 800 may include a first half-shell 810 designed to cooperate in a paired fashion with a second half shell 810. One or more windings 840 and 850 of an inductive device may be provided between the first and second half-shells 810 and 820. Each half-shell may be a unitary structure made of magnetically-conductive material such as ferrite.

The half-shell 810, and similarly half-shell 820, may include a base 810.1 and a plurality of sidewalls 810.2 that define a cavity 810.3 to accommodate the windings 840 and 850. The base 810.1 and sidewalls 810.2 define a profile of the half-shell 810. In an embodiment, the profile may be designed to permit the half-shell 810 to be registered with a counterpart half-shell 820 when the two are mated together.

In an embodiment, the half-shell 810, and similarly half shell 820, also may include a projection 810.4 that extends from the base 810.1 into the cavity 810.3. The projection 810.4 may extend to a height that matches a top profile of the sidewalls 810.2. The projection 810.4, along with the sidewalls 810.2, may define a shape of the cavity 810.3 as some sort of annulus. Although a square-shaped annulus is illustrated in FIG. 8, the principles of the present invention accommodate other geometric arrangements such as circles, rectangles, hexagons, octagons, etc.

Optionally, the half-shell 810 and/or 820, also may have one or more channels provided in either the sidewalls 810.2 or the base 810.1 to accommodate conductors that make up the winding(s) 840, 850 of the inductive device. In an embodiment, the channels may be pre-formed into the half-shell(s). In other embodiments, channels may be formed in the half-shell(s) when the inductive device is manufactured, for example, by drilling.

The one or more windings 840 and 850 may be provided on different planes. As shown in FIG. 8, the first winding 840 (e.g., primary winding) may be provided in the cavity of the first half-shell 810 and the second winding 850 (e.g., secondary winding) may be provided in the cavity of the second half-shell 820. The windings 840, 850 may be electrically isolated from each other, for example, with an insulator 860 provided between the windings. The insulator 860 may also be provided between the windings 840, 850 and the first and second half-shells 810, 820 to provide electrical isolation between the windings and the magnetic core.

The first winding 840 and/or second windings 850 may include spiral windings having a circular, octagonal, or rectangular shape. The windings 840, 850 may be planar spirals. In one embodiment, the first windings 840 may be provided around the projection 810.4 of the first half-shell 810 to generate a magnetic flux perpendicular to the winding and through the projection 810.4. The second winding 850 may also be provided around the projection of the second half shell 820 to receive the magnetic flux generated by the first winding 840.

In one embodiment, the first and second windings 840, 850 may be co-planar (now shown in FIG. 8). While in FIG. 8 a single winding is shown for each of the first and second windings 840, 850, in other embodiments each of the windings 840, 850 may represent a plurality of windings. The plurality of windings may be provided on a same plane or on different planes.

In one embodiment, one of the first and second half-shell 820 may be planar ferrite layer without a cavity and windings. The planar ferrite layer may enclose the cavity of the other half-shell. In this embodiment, the first and second windings may be provided in the same cavity but may still be electrically isolated from each other with an insulator.

Figure 9A:
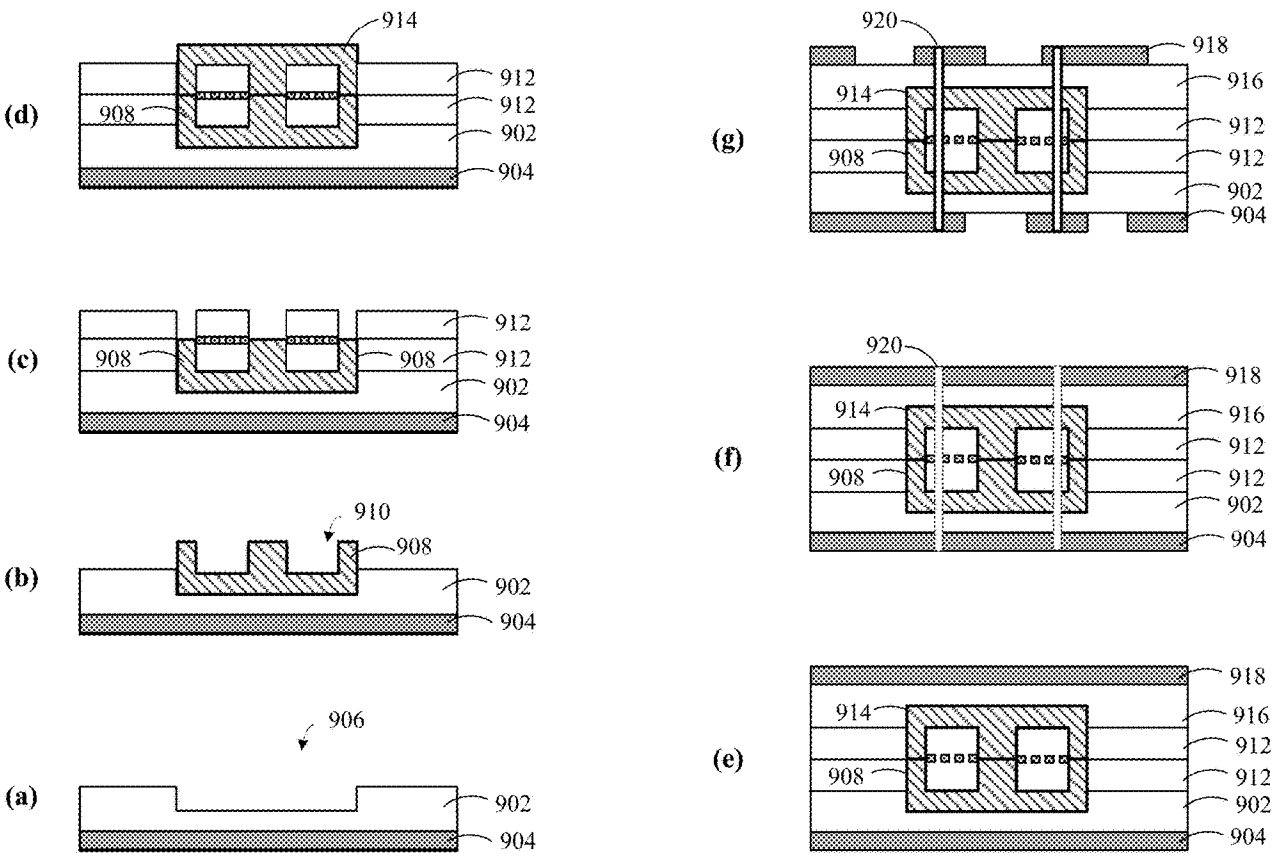
FIGS. 9A and 9B illustrate a process for manufacturing transformer embedded in a PCB according to an embodiment of the present invention.
Figure 9B:
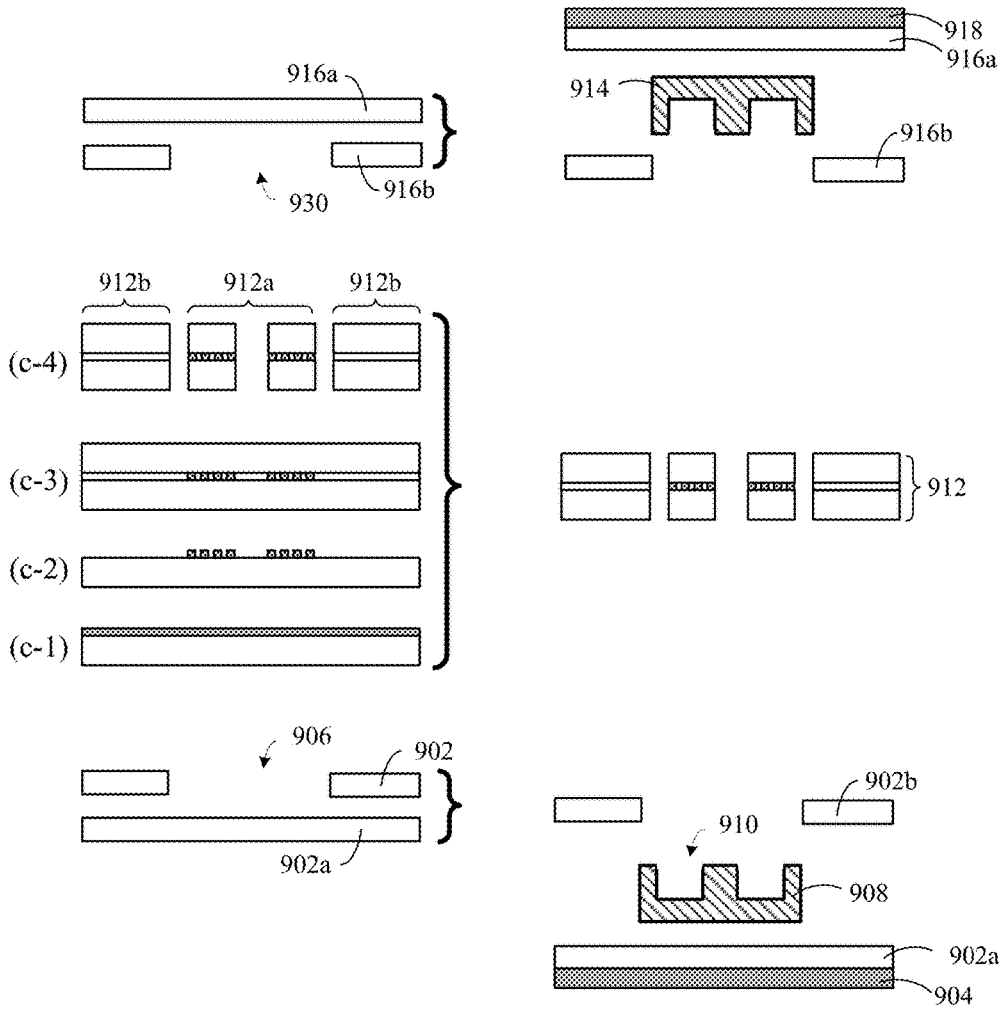

FIGS. 9A and 9B illustrate a process for manufacturing transformer embedded in a PCB according to an embodiment of the present invention. The process may include (a) providing a bottom dielectric layer 902 including a first conducting layer 904 and a bottom dielectric cavity 906, (b) inserting a bottom ferrite housing 908 including a winding cavity 910 into the bottom dielectric cavity 906, (c) providing one or more windings and an insulator 912, (d) providing a top ferrite housing 914 above the bottom ferrite housing 908, (e) providing a top dielectric layer 916 including a second conducting layer 918 above the top ferrite housing 914, (f) forming a plurality of through holes 920, and (g) plating the through holes 920 and etching the first conducting layer 904 and the second conducting layer 918.

FIG. 9B illustrates an example for providing the transformer between two conducting layers 904, 918. As shown in FIG. 9B, the top and bottom ferrite housings 908, 914 may be provided between the first conducting layer 904 and the second conducting layer 918. The various layers shown in FIG. 9B may be laminated together to enclose the top and bottom ferrite housings 908, 914 while providing the windings inside the ferrite housings 908, 914.

Providing the bottom dielectric layer 902 may include laminating a plurality of dielectric layers and a first conducting layer 904. The bottom dielectric layer 902 may include the bottom dielectric cavity 906 in a surface that is opposite to a surface including the first conducting layer 904. The bottom dielectric cavity 906 may be provided in one or more dielectric layers. The bottom dielectric cavity 906 may correspond to the shape of the bottom ferrite housing 908. The bottom dielectric layer 902 may include a first bottom dielectric layer 902*a* and a second bottom dielectric layer 902*b* (e.g., spacer layer) that includes the cavity 906. The bottom dielectric cavity 906 may be formed in the second bottom dielectric layer 902*b* by routing or drilling.

As shown in FIG. 9A, the bottom ferrite housing 908 may be inserted into the bottom dielectric cavity 906 to enclose at least a portion of the bottom ferrite housing 908. The winding cavity 910 in the bottom ferrite housing 908 may hold one or more windings. The bottom ferrite housing 908 may include an opening to couple the one or more windings inside the winding cavity 910 to circuits or components outside of the winding cavity 910 (e.g., the first conducting layer 904 or the second conducting layer 918).

As shown in FIG. 9B, the bottom ferrite housing 908 may be placed on the surface of the dielectric layer 902*a* that is opposite to the surface including the first conducting layer 904. The cavity 906 in the dielectric layer 902*b* may surround the bottom ferrite housing 908. The thickness of the second bottom dielectric layer 902*b* may be approximately 100-300 micrometers.

The one or more windings and the insulator 912 may be provide at least partially inside the winding cavity 910 of the bottom ferrite housing 908. A portion of the insulator 912 (e.g., portion 912*b*) may be provided outside of the winding cavity 910. The windings inside the winding cavity 910 may include a spiral pattern. The insulator may separate the windings from each other and/or from the ferrite housings 908, 914.

As shown in FIG. 9B, the one or more windings and the insulator 912 may be formed by (c-1) providing a dielectric layer including a conducting layer, (c-2) etching the conducting layer to provide one or more spiral windings, (c-3) laminating a dielectric layer above the conducting layer including the spiral windings, and (c-4) forming holes (e.g., by drilling) to form portion 912*a* that will be placed inside the ferrite housing cavity 910 and portion 912*b* that will be provided outside the ferrite housing cavity 910. In another embodiment, the spiral windings may be deposited onto the surface of the dielectric layer. The portion 912*a* that will be provided inside the ferrite housing cavity 910 and portion 912*b* that will be provided outside the ferrite housing cavity 910 may be connected via a section that will be formed in the opening of the ferrite housing. In one embodiment, the portions 912*a* and 912*b* may be held together by the dielectric filling the cavity opening of the ferrite housing (e.g., cavity opening 740 shown in FIG. 7C).

In one embodiment, the thickness of the one or more windings and the insulator 912 may be approximately 2 mil (thousandth of an inch) or less. The dielectric layers above and/or below the windings may be approximately equal to 1 mil or less.

The top ferrite housing 914 may be provided above the bottom ferrite housing 908 to enclose the winding cavity 910 in the bottom ferrite housing 908. The top ferrite housing 914 may include a winding cavity that corresponds to the winding cavity 910 in the bottom ferrite housing 908. In another embodiment, the top ferrite housing 914 may be a flat ferrite plate provided on a top surface of the bottom ferrite housing 908 to enclose the winding cavity 910. In another embodiment, the top ferrite housing 914 and the bottom ferrite housing 908 may have the same shape.

The top dielectric layer 916 may be provided against the surface of the top ferrite housing 914. The second conducting layer 918 may be provided on a surface of the top dielectric layer 916 that is opposite to the surface adjacent to the top ferrite housing 914. The top dielectric layer 916 may include a plurality of dielectric layers. One or more of the dielectric layer may include the cavity surrounding the top ferrite housing 914, which may be formed by routing or drilling.

As shown in FIG. 9B, the top dielectric layer 916 may include a first top dielectric layer 916*a* and a second top dielectric layer 916*b* that includes a cavity 930. The top dielectric cavity 930 may be formed in the second top dielectric layer 902*b* by routing or drilling. The top ferrite housing 914 may be at least partially provided inside the top dielectric cavity 930 of the second top dielectric layer 902*b*.

The plurality of through holes 920 may be formed to couple the windings inside the ferrite housing to components outside of the ferrite housing. The through holes 920 may couple the windings to the first conducting layer 904 and/or the second conducting layer 918. The though holes 920 may be drilled via the openings in the top and bottom ferrite housings 908, 914. The plurality of through holes 920 may be plated to couple two or more of the first conducting layer 904, the second conducting layer 918, and the windings inside the ferrite housings.

The first conducting layer 904 and the second conducting layer 918 may be etched to form circuits and/or other components that may be coupled to the windings inside the ferrite housings 908, 914.

In the above description, for purposes of explanation, numerous specific details have been set forth in order to provide a thorough understanding of the inventive concepts. As part of this description, some structures and devices may have been shown in block diagram form in order to avoid obscuring the invention. Reference in the specification to "one embodiment" or "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

Although the processes illustrated and described herein include series of steps, it will be appreciated that the different embodiments of the present disclosure are not limited by the illustrated ordering of steps, as some steps may occur in different orders, some concurrently with other steps apart from that shown and described herein. In addition, not all illustrated steps may be required to implement a methodology in accordance with the present disclosure. Moreover, it will be appreciated that the processes may be implemented in association with the apparatus and systems illustrated and described herein as well as in association with other systems not illustrated.

As used in any embodiment in the present disclosure, "circuitry" may comprise, for example, singly or in any combination, analog circuitry, digital circuitry, hardwired circuitry, programmable circuitry, state machine circuitry, and/or firmware that stores instructions executed by programmable circuitry. Also, in any embodiment herein, circuitry may be embodied as, and/or form part of, one or more integrated circuits.

It will be appreciated that in the development of any actual implementation (as in any development project), numerous decisions must be made to achieve the developers' specific goals (e.g., compliance with system and business related constraints), and that these goals will vary from one implementation to another. It will also be appreciated that such development efforts might be complex and time consuming, but would nevertheless be a routine undertaking for those of ordinary skill in art having the benefit of this disclosure.

What is claimed is:

1. An inductive device, comprising:

a substrate;

a pair of half-shell magnetically-conductive housings each having a cavity and being joined together to define a first, enclosed cavity between them, and disposed fully within a second cavity in the substrate; and primary and secondary windings provided spatially within the first cavity to provide magnetic coupling between them, the windings electrically insulated from each other by an insulator disposed between the windings that extends into the cavity of each of the half-shell magnetically-conductive housings, wherein terminals of the primary and secondary windings traverse to an exterior of the inductive device.

2. The device of claim 1, wherein the first, enclosed cavity is an annular cavity and the primary and secondary windings spiral around a portion of magnetically-conductive material.

3. The device of claim 1, wherein the primary winding is provided in the cavity in a first half-shell of the pair of half-shell magnetically-conductive housings, and the secondary winding is provided in the cavity in a second half-shell of the pair of half-shell magnetically-conductive housings.

4. The device of claim 1, wherein the primary and secondary windings are co-planar.

5. The device of claim 1, wherein the magnetically-conductive housings are made of a ferrite material.

6. The device of claim 1, wherein the primary and secondary windings are stacked about a common axis.

7. The device of claim 1, wherein at least one of the primary winding or the secondary winding includes a first conducting layer, a second conducting layer, and at least one conducting through hole.

8. The device of claim 7, wherein the at least one conducting through hole connects strips located in the first conducting layer with strips in the second conducting layer.

9. The device of claim 1, wherein a combined thickness of the insulator, the primary winding, and the second winding is no more than 2 mils.

10. The device of claim 1, wherein at least one of the magnetically-conductive housings includes a base and a projection projecting from the base.

11. The device of claim 10, wherein the at least one of the magnetically-conductive housings includes sidewalls, and wherein a height of the projection matches a height of the sidewalls.

12. A printed circuit board (PCB) comprising:

a plurality of PCB layers, including at least one conductor layer and at least one dielectric layer, and an inductive device, provided within a cavity of the printed circuit board that occupies at least two of the PCB layers, the inductive device having a thickness less than that of the PCB and comprising:

a pair of half-shell magnetically-conductive housings each having a cavity and being joined together to define an enclosed cavity between them, and primary and secondary windings provided spatially within the cavity defined by the pair of half-shell magnetically-conductive housings to provide magnetic coupling between them, the windings electrically insulated from each other by an insulator disposed between the windings that extends into the cavity of each of the half-shell magnetically-conductive housings, wherein terminals of the primary and secondary windings traverse to an exterior of the inductive device and are coupled to respective conductors of the printed circuit board.

13. The printed circuit board of claim 12, wherein the enclosed cavity defined by the pair of half-shell magnetically-conductive housings is an annular cavity and the primary and secondary windings spiral around a portion of magnetically-conductive material.

14. The printed circuit board of claim 12, wherein the magnetically-conductive housings are made of a ferrite material.

15. The printed circuit board of claim 12, wherein the primary and secondary windings are stacked about a common axis.

16. The printed circuit board of claim 12, wherein the primary and secondary windings are co-planar.

17. The printed circuit board of claim 12, wherein at least one of the primary or secondary windings is coupled to at least one component on or within the printed circuit board.

18. The printed circuit board of claim 12, wherein at least one of the primary winding or the secondary winding includes a first conducting layer, a second conducting layer, and at least one conducting through hole.

19. The printed circuit board of claim 18, wherein the at least one conducting through hole connects strips located in the first conducting layer with strips in the second conducting layer.

20. The printed circuit board of claim 12, wherein a first of the magnetically-conductive housings is registered with a second of the magnetically-conductive housings.

21. The printed circuit board of claim 12, wherein at least one of the magnetically-conductive housings includes a base and a projection projecting from the base.

22. The printed circuit board of claim 21, wherein the at least one of the magnetically-conductive housings includes sidewalls, and wherein a height of the projection matches a height of the sidewalls.

23. The printed circuit board of claim 22, wherein the sidewalls and the projection define a shape of the cavity defined by the pair of half-shell magnetically-conductive housings as an annulus.

* * * * *